US012152801B2

(12) United States Patent
Okamoto

(10) Patent No.: US 12,152,801 B2
(45) Date of Patent: Nov. 26, 2024

(54) STRUCTURE

(71) Applicant: Tsuneyuki Okamoto, Tokyo (JP)

(72) Inventor: Tsuneyuki Okamoto, Tokyo (JP)

( * ) Notice: Subject to any disclaimer, the term of this patent is extended or adjusted under 35 U.S.C. 154(b) by 137 days.

(21) Appl. No.: 17/992,114

(22) Filed: Nov. 22, 2022

(65) Prior Publication Data

US 2023/0168001 A1 Jun. 1, 2023

(30) Foreign Application Priority Data

Nov. 29, 2021 (JP) ..... 2021-193103

(51) Int. Cl.
*F24F 13/02* (2006.01)
*E04B 1/70* (2006.01)
*F24F 7/00* (2021.01)

(52) U.S. Cl.
CPC ..... *F24F 13/0227* (2013.01); *E04B 1/7069* (2013.01); *F24F 7/00* (2013.01); *F24F 2007/0025* (2021.01)

(58) Field of Classification Search
CPC .... E04B 1/7076; E04B 1/7084; E04B 1/7069; E04C 1/392; E04C 2/523; F24F 7/00; F24F 2007/004; F24F 2007/0025; F24F 13/0227
See application file for complete search history.

(56) References Cited

U.S. PATENT DOCUMENTS 1,680,626 A * 8/1928 Meyer ..... B65G 69/20 52/192
7,250,000 B2 * 7/2007 Daniels, II ..... E04D 12/004 454/250
2006/0052051 A1 * 3/2006 Daniels, II ..... E04D 13/174 454/365

FOREIGN PATENT DOCUMENTS

DE 664954 C * 9/1938
FR 418022 A * 11/1910
GB 205221 A * 10/1923
GB 265817 A * 2/1927
GB 600358 A * 4/1948
GB 1255146 A * 11/1971
JP S59-52260 12/1984
JP H8-233317 9/1996
(Continued)

OTHER PUBLICATIONS

JPO, Notice of Allowance of JP 2021-193103 dated Aug. 10, 2022.
JPO, Office Action of JP 2021-193103 dated Feb. 21, 2022.
JPO, Office Action of JP 2021-193103 dated Jun. 9, 2022.

*Primary Examiner* — Christine T Cajilig
(74) *Attorney, Agent, or Firm* — LEX IP MEISTER, PLLC

(57) ABSTRACT

To provide a structure that can improve air permeability from a first space to a second space and can prevent a building structure from increasing in size. A wall 11 has: a body section 35 separating an outside A1 from a living space B1 of a building; a ventilation device 30 provided in the body section 35; and a first ventilation channel 24 and a second ventilation channel 25 provided in the ventilation device 30, the first ventilation channel 24 and the second ventilation channel 25 sending air in the outside A1 to the living space B1, wherein arrangement ranges L1 and L2 of the ventilation device 30 in a thickness direction of the body section 35 are within an arrangement range L3 of the body section 35, and a cross-sectional area of the first ventilation channel 24 in a plane perpendicular to a virtual line E1 indicating a center of the second ventilation channel 24 narrows as it approaches the living space B1 along the virtual line E1.

6 Claims, 9 Drawing Sheets

(56) References Cited

FOREIGN PATENT DOCUMENTS

| | | |
|---|---|---|
| JP | H10-77696 | 3/1998 |
| JP | 2000-45410 | 2/2000 |
| JP | 2002-115407 | 4/2002 |
| JP | 2006-2395 | 1/2006 |
| JP | 2020-26936 | 2/2020 |
| JP | 2020-70991 | 5/2020 |
| WO | WO-2019170358 A1 * | 9/2019 |

* cited by examiner

STRUCTURE

TECHNICAL FIELD

The present disclosure relates to a structure including a ventilation device for sending air from a first space to a second space.

BACKGROUND ART

Patent Literature 1 (PTL1) describes an example of a structure with a ventilation device that sends air from the outside (first space) to the inside (second space) of a building. The structure described in PTL 1 is a ventilation structure in a multi-story apartment house, in which multiple dwelling units are arranged in the left-right direction on each floor. The ventilation structure described in PTL 1 has at least one of the unit boundary walls dividing dwelling units adjacent to each other on a given floor with double walls arranged at predetermined intervals. In addition, a balcony is provided outside each dwelling unit, and the double wall is integrated with the balcony's handrail wall. Furthermore, the double wall is extended from the dwelling unit side to the outside and is extendedly formed in parallel until a halfway point and extendedly formed in spreading out in a trumpet shape in the left-right directions from the halfway point. PTL 1 states that the space between the double walls comprising the unit boundary walls can function as a ventilation channel with high air distribution efficiency, thereby sufficiently enhancing the ventilation of the living space of each dwelling unit in a multi-story apartment house.

CITATION LIST

Patent Literature

[Patent Literature 1] Japanese Unexamined Patent Application Publication No. 2002-115407

SUMMARY OF THE INVENTION

Problems to be Solved by the Invention

The inventor of the present application recognized the problem that the structure described in PTL 1 is exclusively provided on a balcony to partition adjacent dwelling units, thus increasing the size of the building structure.

The purpose of the present disclosure is to provide a structure that can improve air permeability from a first space to a second space and can prevent a structure of a building from increasing in size.

Means for Solving the Problems

The structure of the present disclosure has a body section separating a first space from a second space; a ventilation device provided in the body section; and a ventilation channel provided in the ventilation device, the ventilation channel sending air in the first space to the second space, wherein an arrangement range of the ventilation device in a thickness direction of the body section is within an arrangement range of the body section, and a cross-sectional area of the ventilation channel in a plane perpendicular to a virtual line indicating a center of the ventilation channel narrows as it approaches the second space along the virtual line.

Effect of the Invention

The structure of the present disclosure can improve ventilation performance from a first space to a second space and can prevent a structure of a building from increasing in size.

MODES FOR CARRYING OUT THE INVENTION

Summary

A structure of the present disclosure is designed to improve air permeability and ventilation performance from a first space to a second space, and a ventilation device is provided in the structure itself. The following is a description of the embodiment of the present disclosure based on the drawings. The configuration of the following embodiments is illustrative and the present disclosure is not limited to the contents of the embodiments.

Example

Figure 1A:
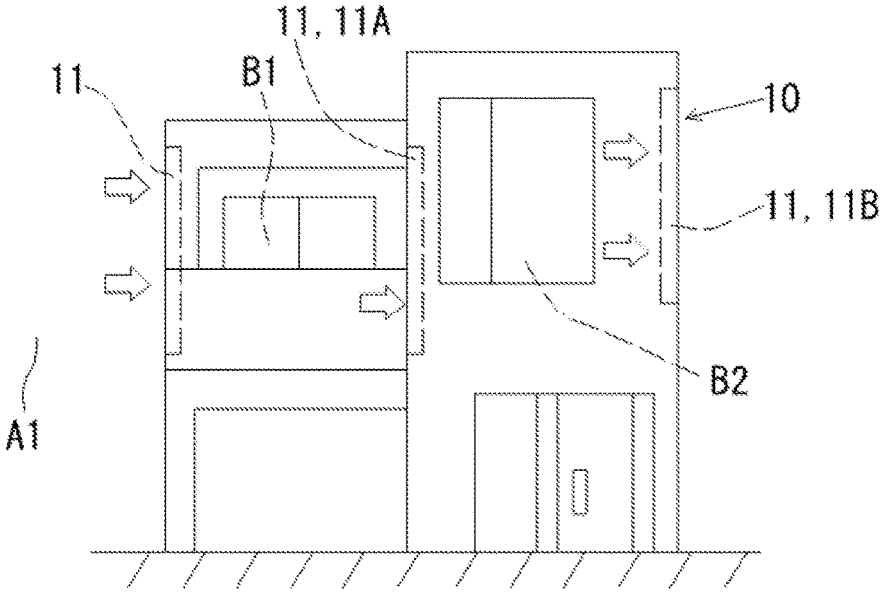
FIG. 1A is an outside view of an example building.
Figure 1B:
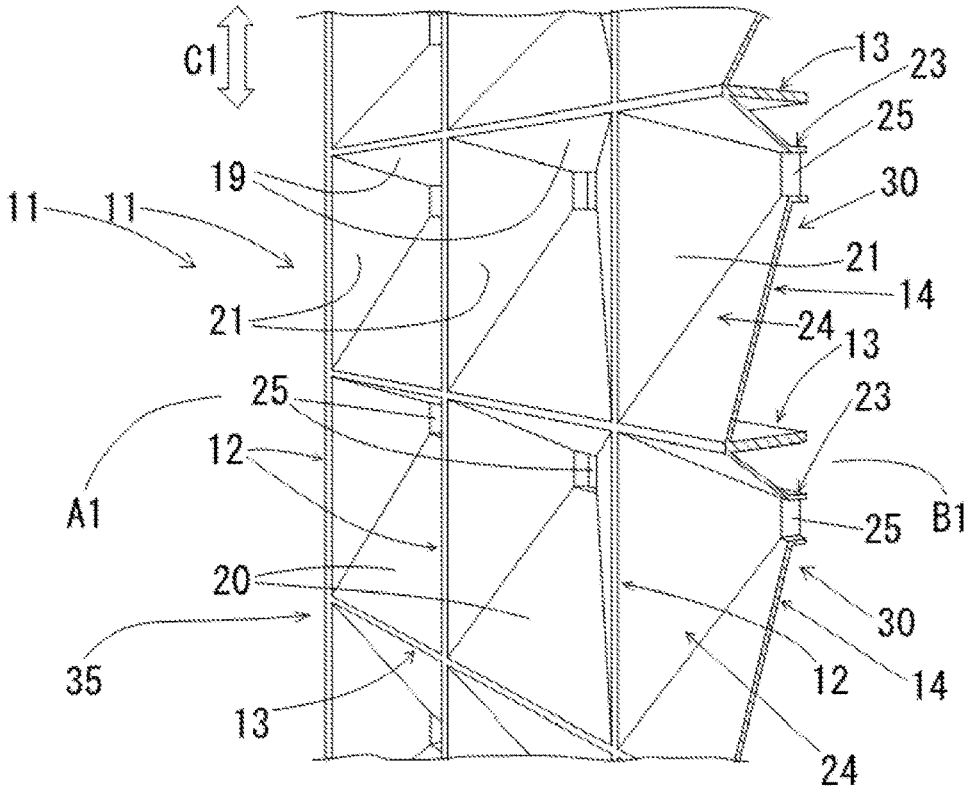
FIG. 1B is a cross-sectional view of a wall provided in the building.
Figure 2:
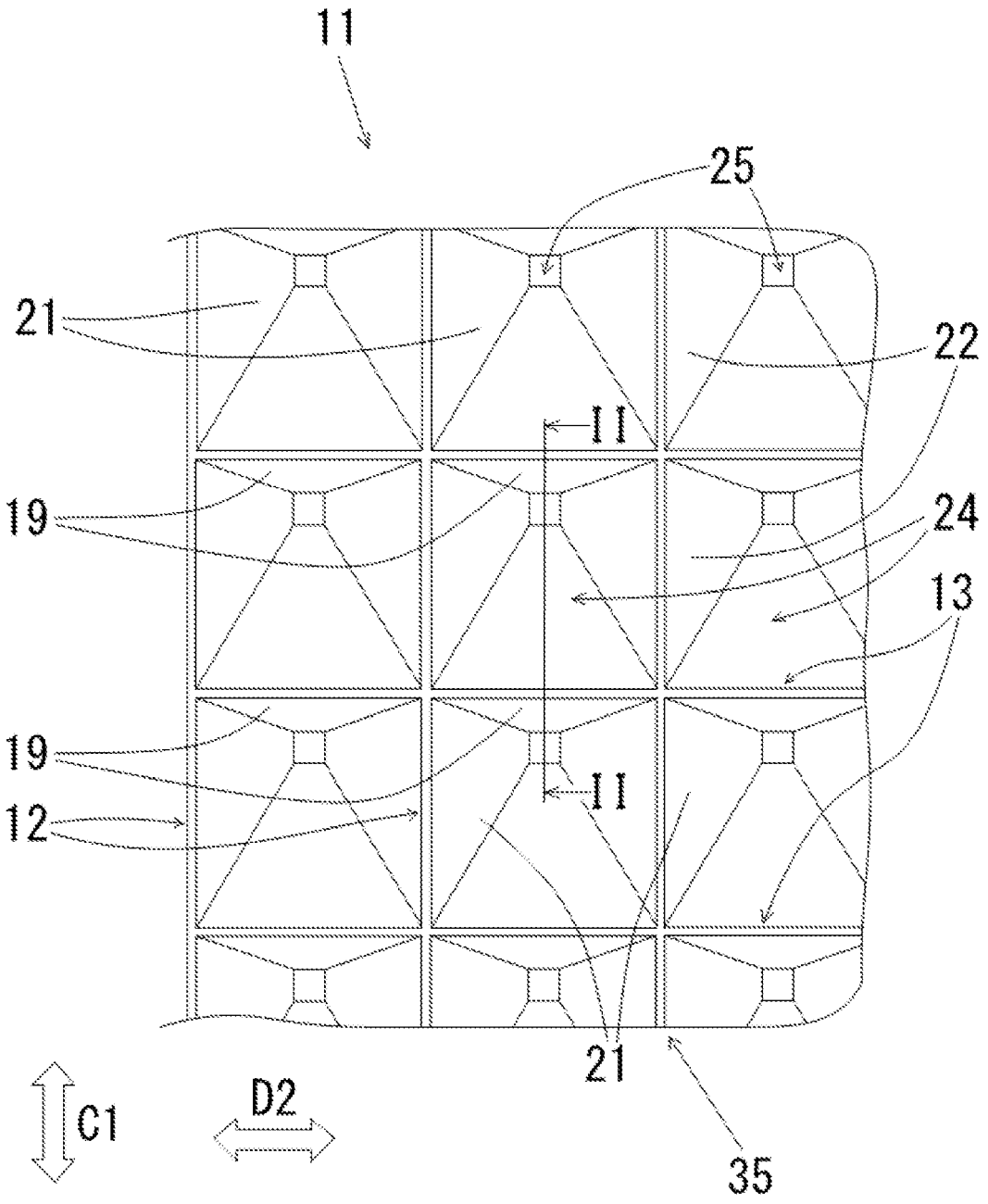
FIG. 2 is a front view of the wall viewing from outside the building.
Figure 3:
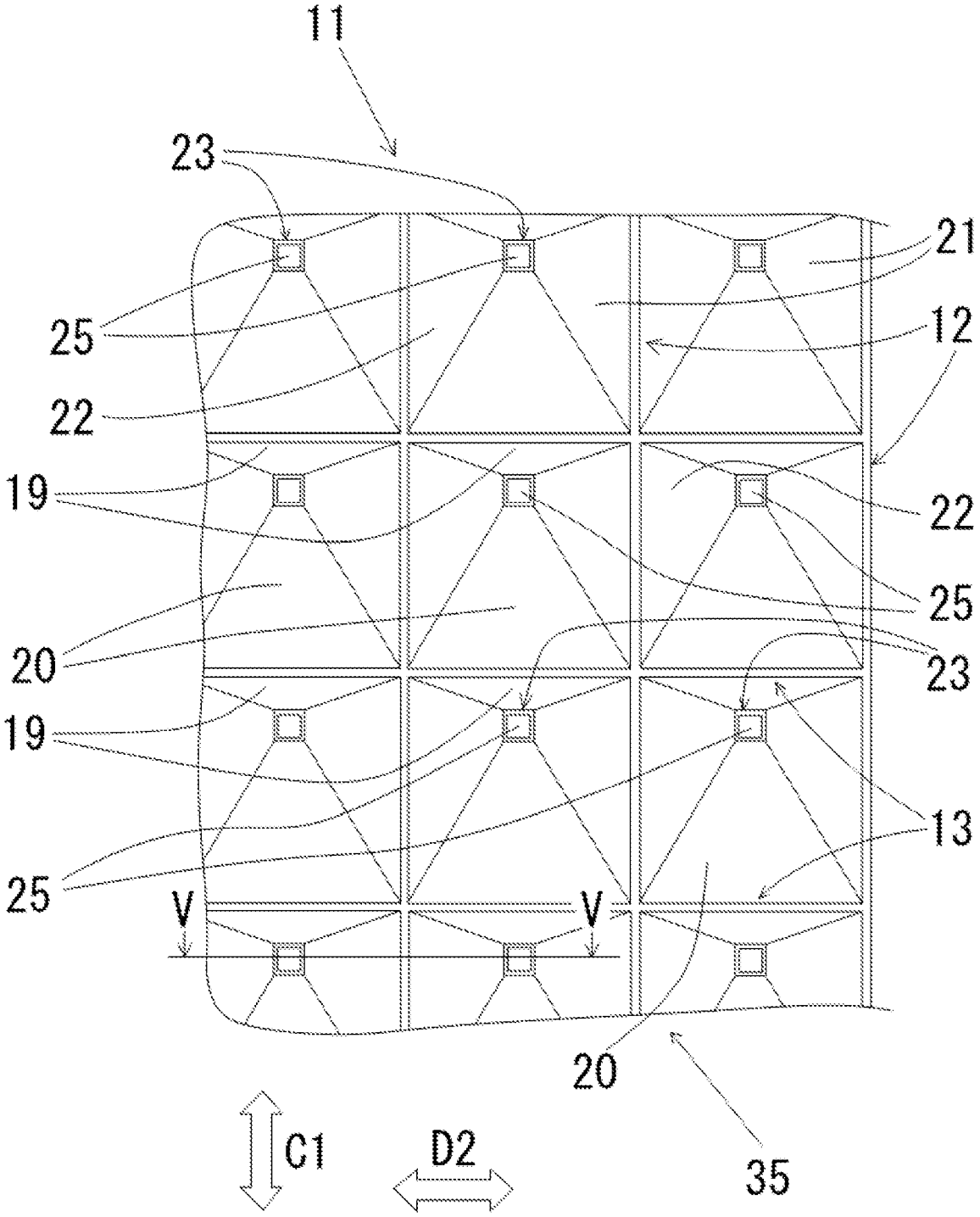
FIG. 3 is a rear view of the wall viewing from inside the building.
Figure 4:
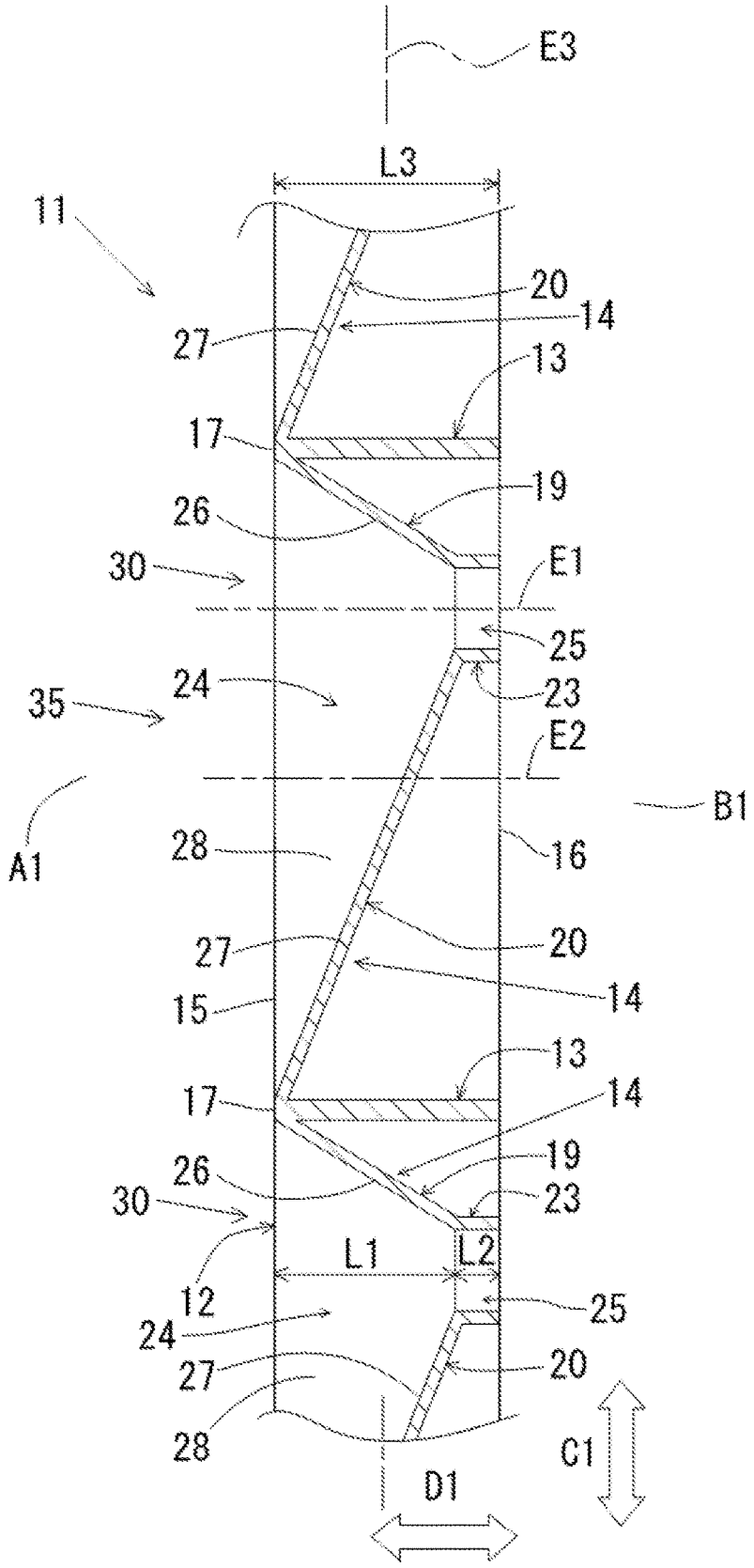
FIG. 4 is a side cross-sectional view at the II-II line of FIG. 2.
Figure 5:
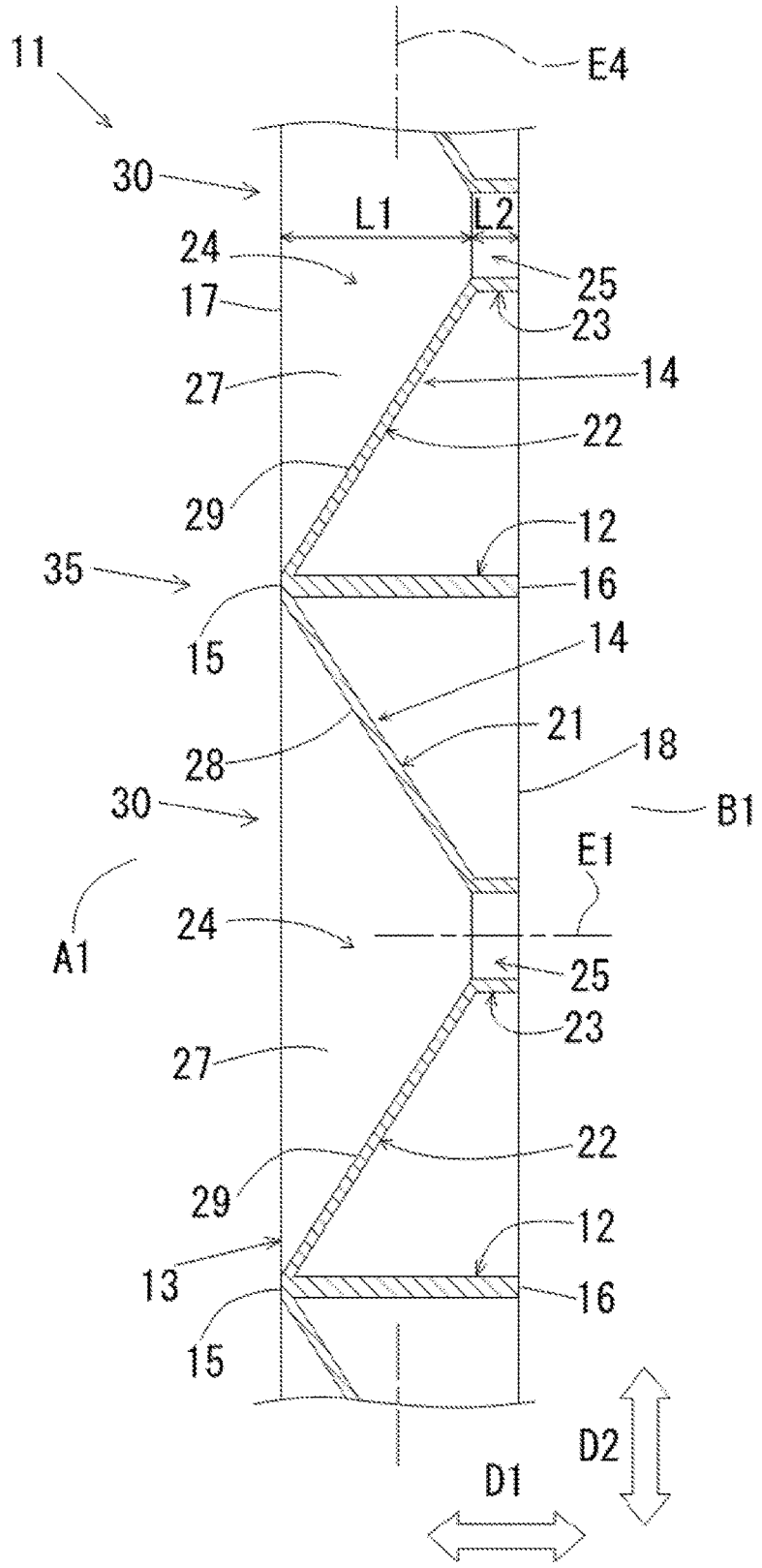
FIG. 5 is a planar cross-sectional view at the V-V line of FIG. 3.

Building 10 shown in FIG. 1A is a detached house (a house) as an example, and the building 10 has walls 11 as shown in FIG. 1B, FIG. 2, FIG. 3, FIG. 4, and FIG. 5. The wall 11 is the structure that separates outside A1 of building 10 from living space B1. The wall 11 extends along a vertical direction, i.e., the action direction of gravity. The wall 11 is extended, as an example, linearly in a side cross-sectional view, as shown in FIG. 4, and the wall 11 is extended, as an example, linearly in a planar cross-sectional view, as shown in FIG. 5. The wall 11 has body section 35 and a ventilation device 30. A body section 35 is a structure that ensures the strength of the wall 11, and the body section 35 has vertical frames 12 and horizontal frames 13.

The vertical frame 12 is a plate-shaped structural element extending along a vertical direction C1 and having a width in a first direction D1 from the outside A1 to the living space B1. In FIG. 4, a side cross-sectional view of the wall 11, a virtual line E3, which shows the center of the body section 35 in the thickness direction of the body section 35, i.e., in the first direction D1, and extends in the vertical direction C1, is a straight line. In FIG. 5, a planar cross-sectional view of the wall 11, a virtual line E4 shows the center of the body section 35 in the first direction D1, and extends in the horizontal direction, is a straight line.

As shown in FIG. 4, the first direction D1 is horizontal and intersects the vertical direction C1. When the wall 11 is viewed from the outside A1 of the building 10, as shown in FIG. 2, the vertical frames 12 are arranged linearly along the vertical direction C1. The vertical frame 12 has a first side edge 15 and a second side edge 16 as shown in FIG. 4. The first side edge 15 is located in the vertical frames 12 closest to the outside A1. The second side edge 16 is located in the vertical frames 12 closest to the living space B1. The first side edge 15 and the second side edge 16 are parallel. Also, a plurality of vertical frames 12 is provided, and the plurality of vertical frames 12 is arranged parallel to each other. Furthermore, as shown in FIG. 2 and FIG. 3, the plurality of vertical frames 12 has the same spacing in a second direction D2 between each other. The second direction D2 is horizontal and intersects the first direction D1.

The horizontal frame 13 is a plate-shaped structural element that extends along the first direction D1, and has a width of the second direction D2. As shown in FIG. 2, when the wall 11 is viewed from the front, the horizontal frames 13 are arranged linearly along the second direction D2. The horizontal frame 13 has a first side edge 17 and a second side edge 18 as shown in FIG. 5. The first side edge 17 is located in the horizontal frames 13 closest to the outside A1. The second side edge 18 is located in the horizontal frames 13 closest to the living space B1. The first side edge 17 and the second side edge 18 are parallel. A plurality of horizontal frames 13 is provided as shown in FIG. 2 and FIG. 3, and the plurality of horizontal frames 13 are arranged parallel to each other. The plurality of horizontal frames 13 has the same spacing in the vertical direction C1 between each other.

Then, at the intersection of the vertical frame 12 and the horizontal frame 13, the vertical frame 12 and the horizontal frame 13 are connected. Therefore, both in the front view of the wall 11 from the outside A1 as shown in FIG. 2 and in the rear view of the wall 11 from the living space B1 as shown in FIG. 3, the plurality of vertical frames 12 and the plurality of horizontal frames 13 are arranged in a grid pattern.

The ventilation device 30 is a mechanism for sending air of the outside A1 to the living space B1, and the ventilation device 30 has first tube sections 14 and second tube sections 23. A plurality of first tube section 14 is provided, and each first tube section 14 is located between two vertical frames 12 and between two horizontal frames 13, respectively. Each of the plurality of first tube sections 14 is connected to the vertical frames 12 and the horizontal frames 13. The first tube section 14 has an upper plate 19, a lower plate 20, side plates 21 and 22, and the second tube section 23.

As shown in FIG. 4, the upper plate 19 locates above the lower plate 20 in the vertical direction C1. The part of the upper plate 19 closest to the outside A1 connects with the first side edge 17 of the horizontal frame 13. The part of the upper plate 19 closest to the living space B1 connects with the second tube section 23. The part of the lower plate 20 closest to the outside A1 connects with the first side edge 17 of the horizontal frame 13. The part of the lower plate 20 closest to the living space B1 connects with the second tube section 23.

As shown in FIG. 4 and FIG. 5, the side plate 21 connects with the first side edge 15 of the vertical frame 12, the second tube section 23, the upper plate 19, and the lower plate 20, respectively. The side plate 22 connects with the first side edge 15 of the vertical frame 12, the second tube section 23, upper plate 19, and lower plate 20, respectively. As shown in FIG. 3, viewing the wall 11 from the rear, the shape of the second tube section 23 is a quadrangle, specifically, rectangular or square. In the space enclosed by the upper plate 19, the lower plate 20, and the side plates 21 and 22, the first ventilation channel 24 is formed. Viewing the wall 11 from the front, as shown in FIG. 2, the opening shape of the first ventilation channel 24 is a quadrangle, e.g., square or rectangular. Also, the second tube section 23 has a second ventilation channel 25.

Viewing the wall 11 from the rear as shown in FIG. 3, the opening shape of the second ventilation channel 25 is a quadrangle, e.g., square or rectangular. The first ventilation channel 24 connects with the outside A1 and the second ventilation channel 25, and the second ventilation channel 25 connects with the living space B1. In other words, the first ventilation channel 24 and the second ventilation channel 25 apparently penetrate the wall 11. Thus, the air in outside A1 can flow into the living space B1 through the first ventilation channel 24 and the second ventilation channel 25. As shown in FIG. 4, the virtual line E1, which indicates the center of the second tube section 23, i.e., the center of the second ventilation channel 25, is a straight line. The virtual line E1 is horizontal and aligned with the first direction D1.

As shown in FIG. 4, in the direction along the virtual line E1, an arrangement range L1 of the first ventilation channel 24 exceeds an arrangement range L2 of the second ventilation channel 25. In addition, the arrangement range L1 and the arrangement range L2 do not overlap. Furthermore, all of the arrangement range L1 and the arrangement range L2 are located within an arrangement range L3 of the body section 35. As shown in FIG. 2, two adjacent vertical frames 12 and two adjacent horizontal frames 13 are connected to construct a circular frame, and inside the circular frame, i.e., in the area or space enclosed by the frame, the first ventilation channel 24 and the second ventilation channel 25 are provided respectively.

In addition, of the upper plate 19, a flat surface 26 forming the first ventilation channel 24 has a slope inclined to the virtual line E1. Of the lower plate 20, a flat surface 27 forming the first ventilation channel 24 has a slope inclined to the virtual line E1. In the vertical direction C1, the virtual line E1 of the second ventilation channel 25 formed between adjacent horizontal frames 13 is located above a virtual line E2 that marks the center between adjacent horizontal frames 13. The virtual line E2 can also be defined as the centerline of the entrance of the first ventilation channel 24. A slope angle of an acute angle side of the flat surface 26 inclined to the virtual line E1 is smaller than a slope angle of an acute angle side of the flat surface 27 inclined to the virtual line E1.

As shown in FIG. 5, of the side plate 21, a flat surface 28 forming the first ventilation channel 24 has a slope inclined to the virtual line E1. Of the side plate 22, a flat surface 29 forming the first ventilation channel 24 has a slope inclined to the virtual line E1. A slope angle on an acute side of the flat surface 28 inclined to the virtual line E1 and a slope angle on an acute side of the flat surface 29 inclined to the virtual line E1 are identical.

Furthermore, as shown in FIG. 4, the cross-sectional area of the second ventilation channel 25 in the plane perpendicular to the virtual line E1 is identical in the direction along the virtual line E1. Furthermore, the cross-sectional area of the first ventilation channel 24 in the plane perpendicular to the virtual line E1 becomes narrower as it approaches the second ventilation channel 25. Furthermore, the minimum cross-sectional area of the first ventilation channel 24 in the plane perpendicular to the virtual line E1 is identical to the cross-sectional area of the second ventilation channel 25 in the plane perpendicular to the virtual line E1. The first tube section 14 and the second tube section 23, described above, constitute the ventilation device 30. The first tube section 14 and the second tube section 23 are connected to form a funnel shape.

The materials of the vertical frame 12, the horizontal frame 13, the first tube section 14, and the second tube section 23 are not limited. For example, the materials may be any of the following: metal, glass, synthetic resin, concrete, etc. In addition, the materials of the vertical frame 12, the horizontal frame 13, the first tube section 14, and the second tube section 23 may all be different, or materials of several elements may be identical. In FIG. 4 and FIG. 5, the hatching on the cross sections of the vertical frame 12, the horizontal frame 13, the first tube section 14, and the second tube section 23 are common for convenience. The common hatching does not mean that the materials of the vertical frame 12, the horizontal frame 13, the first tube section 14, and the second tube section 23 are identical. The ventilation device 30 also maybe a unit integrating the first tube section 14 and the second tube section 23 beforehand. The ventilation device 30 is arranged in a space enclosed by two vertical frames 12 and two horizontal frames 13, and the first tube section 14 is connected to the vertical frames 12 and the horizontal frames 13.

Next, the action of the ventilation device 30 of the present disclosure is described. The air in outside A1 flows into the living space B1 through the first ventilation channel 24 and the second ventilation channel 25. The cross-sectional area of the first ventilation channel 24 in the plane perpendicular to the virtual line E1 becomes narrower as it approaches the second ventilation channel 25. Here, the air velocity in the first ventilation channel 24 is determined by:

the airflow rate [$m^3$]/cross-sectional area of the first ventilation channel 24 [$m^2$]. Thus, if the airflow rate is constant, the velocity of the air flowing through the first ventilation channel 24 becomes faster as it approaches the second ventilation channel 25. Therefore, ventilation in the living space B1 of the building 10 can be facilitated. Therefore, condensation and the like in the structure surrounding the living space B1 can be suppressed and aging of the building 10 can be suppressed. Also, the ventilation device 30 is part of the body section 35. Furthermore, the arrangement range L1 and L2 in the thickness direction of the body section 35, i.e., along the first direction D1, are within the placement range L3 of the body section 35. Thus, the structure of the wall 11 can be prevented from increasing in size along the first direction D1. In addition, the ventilation device 30 does not interfere with the movement of people and the like in the living space B1 and outside A1.

In addition, the frequency of use, the duration of use, and the like of the air conditioning equipment used to air-condition the living space B1 can be reduced. Furthermore, the concentration of carbon dioxide in the air in the inside A2 can be reduced by fresh air being drawn into the living space B1. Furthermore, the ventilation device 30 does not consume electrical power. Furthermore, as shown in FIG. 4, in the vertical direction C1, the virtual line of the second ventilation channel 25 is located above the virtual line E2 at the entrance of the first ventilation channel 24. Thus, if it rains outside A1, rain is prevented from entering the second ventilation channel 25. In FIG. 4, the virtual line E1 and the virtual line E2 may be located at the same height, or the virtual line E1 may be located below the virtual line E2. In FIG. 5, the virtual lines E1 and E2 may be centered between a horizontal frame 13 and a horizontal frame 13, or the virtual lines E1 and E2 may be positioned closer to one of the horizontal frames 13.

Other Examples

Figure 6A:
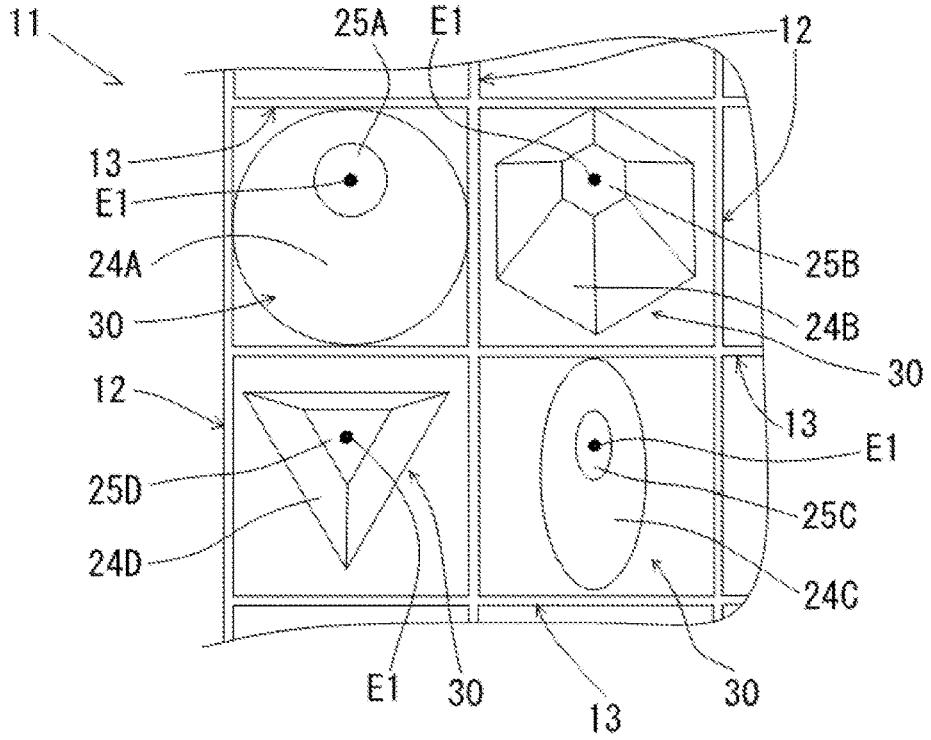
FIG. 6A is a front view illustrating another example of the shape of the ventilation channel.
Figure 6B:
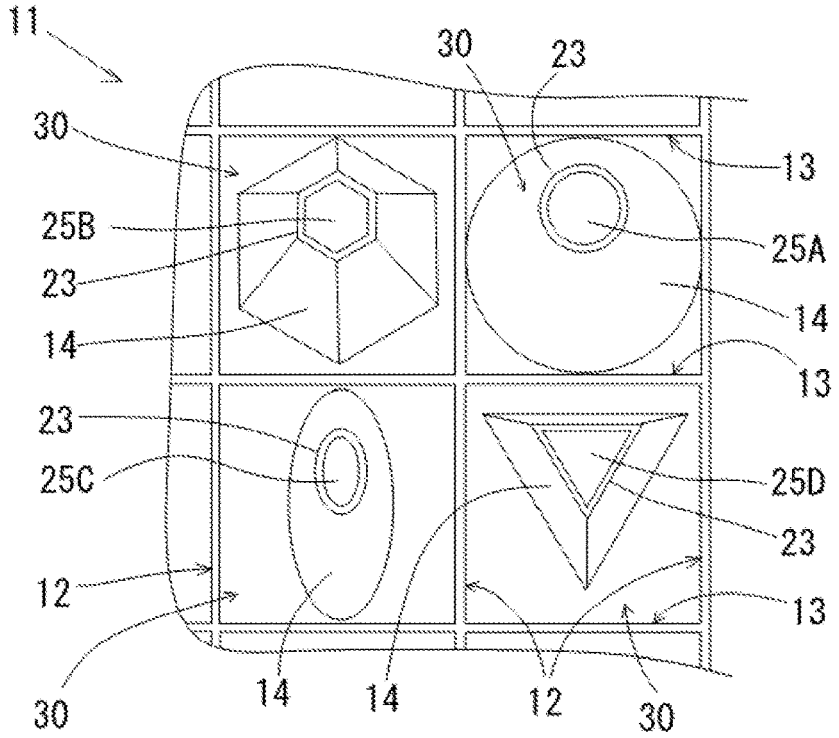
FIG. 6B is a rear view illustrating another example of the shape of the ventilation channel.

FIG. 6A is a front view illustrating a portion of wall 11, and FIG. 6A inclusively shows other geometry examples of the first ventilation channel 24A, and the second ventilation channel 25A. FIG. 6A shows the shape of the first ventilation channel 24A and the shape of the second ventilation channel 25A in the plane perpendicular to the virtual line E1. FIG. 6B is a front view illustrating a portion of wall 11, and FIG. 6B inclusively shows other geometry examples of the first tube section 14, and the second tube section 23. Shapes of the first ventilation channel 24A of the first tube section 14 and the second ventilation channel 25A are circular. Furthermore, the cross-sectional area of the second ventilation channel 25A in the plane perpendicular to the virtual line E1 is identical in the direction along the virtual line E1. Furthermore, the cross-sectional area of the first ventilation channel 24A in the plane perpendicular to the virtual line E1 becomes narrower as it approaches the second ventilation channel 25A. Furthermore, the minimum cross-sectional area of the first ventilation channel 24A in the plane perpendicular to the virtual line E1 is identical to the cross-sectional area of the second ventilation channel 25A in the plane perpendicular to the virtual line E1.

The frontal shape of the first ventilation channel 24B of the first tube section 14 and the second ventilation channel 25B of the second tube section 23 are hexagonal. Furthermore, the cross-sectional area of the second ventilation channel 25B in the plane perpendicular to the virtual line E1 is identical in the direction along virtual line E1. Furthermore, the cross-sectional area of the first ventilation channel 24B in the plane perpendicular to the virtual line E1 becomes narrower as it approaches the second ventilation channel 25B. Furthermore, the minimum cross-sectional area of the first ventilation channel 24B in the plane perpendicular to the virtual line E1 is identical to the cross-sectional area of the second ventilation channel 25B in the plane perpendicular to the virtual line E1.

The frontal shape of the first ventilation channel 24C of the first tube section 14 and the second ventilation channel 25C of the second tube section 23 are oval. Furthermore, the cross-sectional area of the second ventilation channel 25C in the plane perpendicular to the virtual line E1 is identical in the direction along virtual line E1. Furthermore, the cross-sectional area of the first ventilation channel 24C in the plane perpendicular to the virtual line E1 becomes narrower as it approaches the second ventilation channel 25C. Furthermore, the minimum cross-sectional area of the first ventilation channel 24C in the plane perpendicular to the virtual line E1 is identical to the cross-sectional area of the second ventilation channel 25C in the plane perpendicular to the virtual line E1.

The frontal shape of the first ventilation channel 24D of the first tube section 14 and the first ventilation channel 25D of the second tube section 23 are triangular. Furthermore, the cross-sectional area of the second ventilation channel 25D in the plane perpendicular to the virtual line E1 is identical in the direction along virtual line E1. Furthermore, the cross-sectional area of the first ventilation channel 24D in the plane perpendicular to the virtual line E1 becomes narrower as it approaches the second ventilation channel 25D. Furthermore, the minimum cross-sectional area of the first ventilation channel 24D in the plane perpendicular to the virtual line E1 is identical to the cross-sectional area of the second ventilation channel 25D in the plane perpendicular to the virtual line E1.

The four types of ventilation devices 30 shown in FIG. 6A and FIG. 6B have the same effect as the ventilation devices 30 shown in FIG. 2 through 5. In addition, multiple combinations of the ventilation channels among follows with different shapes in the front view of the wall 11 can be provided: the first ventilation channel 24 and the second ventilation channel 25, shown in FIG. 2 and FIG. 3, and the first ventilation channel 24A and the second ventilation channel 25A, the first ventilation channel 24B and the second ventilation channel 25B, the first ventilation channel 24C and the second ventilation channel 25C, and the first ventilation channel 24D and the second ventilation channel 25D, shown in FIG. 6A and FIG. 6B.

Figure 7:
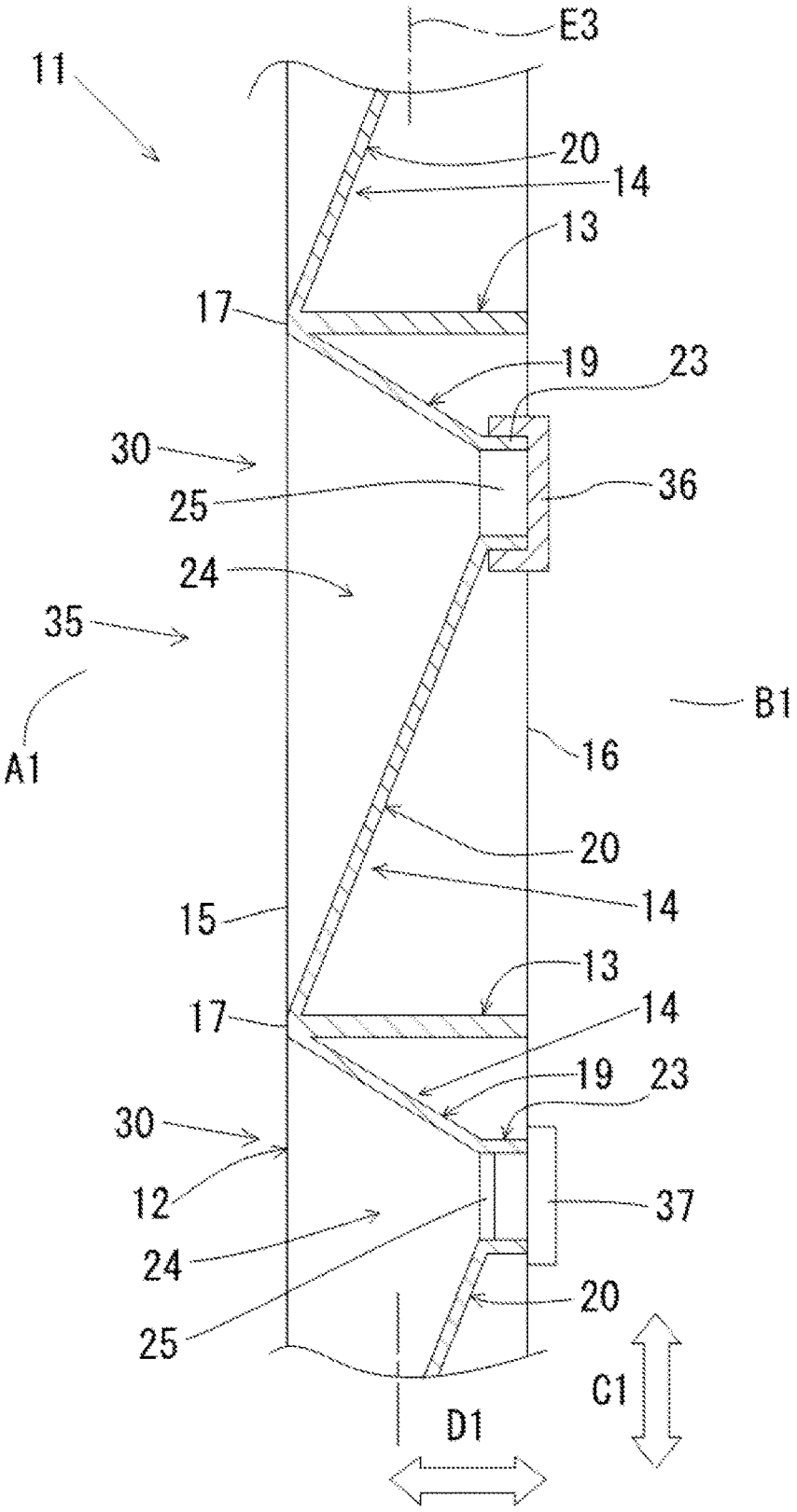
FIG. 7 is a side cross-sectional view illustrating an example with a sealing device that blocks the ventilation channel.

FIG. 7 is a side cross-sectional view illustrating an example of sealing devices 36 and 37 that block the second ventilation channel 25. The sealing device 36 is attached to the outer circumference of the second tube section 23. The sealing device 36 can be applied to any of the second tube sections 23 in FIG. 2 through FIG. 6. The user can grab the sealing device 36 and attach and remove it from the second tube section 23. The sealing device 36 and the second tube section 23 may be secured by threaded coupling or by fitting together. When the sealing device 36 is removed from the second tube section 23, the same effect of the ventilation device 30 in FIG. 2 through FIG. 6 can be achieved. When the sealing device 36 is attached to the second tube section 23, the air is prevented from entering the living space B1 from the outside A1, and rain, insects, or other foreign matter can be reliably prevented from entering the living space B1 from the outside A1.

In addition, the sealing device 37 is fitted into the second ventilation channel 25 of the second tube section 23. The sealing device 37 can be applied to any of the second tube sections 23 in FIG. 2 through FIG. 6. The user can grab the sealing device 37 and attach and remove it from the second tube section 23. When the sealing device 37 is removed from the second tube section 23, the same effect of the ventilation device 30 in FIG. 2 through FIG. 6 can be achieved. When the sealing device 37 is attached to the second tube section 23, the air is prevented from entering the living space B1 from the outside A1, and rain, insects, or other foreign matter can be reliably prevented from entering the living space B1 from the outside A1. The material of sealing devices 36 and 37 can be any of metal, synthetic resin, or synthetic rubber.

Figure 8:
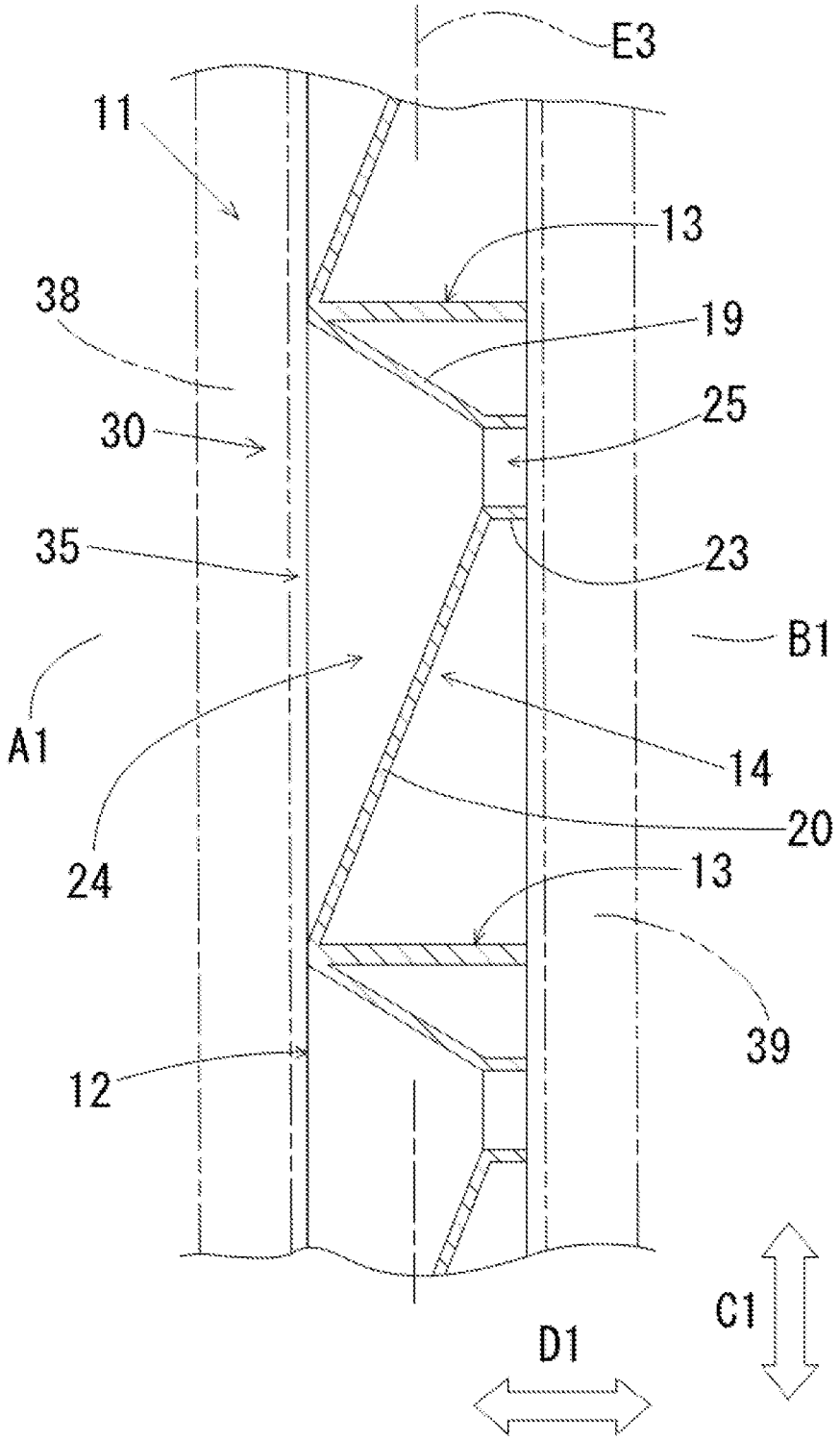
FIG. 8 is a side cross-sectional view illustrating an example with shutters on the outside and inside of the wall.

FIG. 8 shows an example with a shutter 38 on the outside A1 side from wall 11 and a shutter 39 on the living space B1 side from wall 11. A guide member which can allow the shutter 38 capable of moving in the second direction D2 shown in FIG. 2 or capable of moving in the vertical direction C1 is provided. Then, the shutter 38 is moved and stopped by manual operation by the user, the power of an electric motor, and the like. When shutter 38 is provided on the outside A1 side of the wall 11, the outside A1 and the first ventilation channel 24 are blocked by the shutter 38. Therefore, the air is prevented from entering the living space B1 from the outside A1, and rain, insects, or other foreign matter can be reliably prevented from entering the living space B1 from the outside A1.

A guide member which can allow a shutter 39 capable of moving in the second direction D2 shown in FIG. 2 or capable of moving in the vertical direction C1 is provided. Then, the shutter 38 is moved and stopped by manual operation by the user, the power of an electric motor, and the like. When shutter 39 is provided on the living space B1 side of the wall 11, the air is prevented from entering the living space B1 from the outside A1 Further, the shutter 39 may be positioned in contact with the wall 11. In this way, the shutter 39 can open and close the second ventilation channel 25 as the shutter 39 is moved. Furthermore, either or both of the shutters 38 and 39 may be provided. The shutters 38 and 39 are each made of metal for example. In addition, if sealing devices 36 or 37 are used or shutters 38 or 39 are present, the living space B1 cannot be seen from the outside A1 through the first ventilation channels 24 and second ventilation channels 25 so that the privacy of the living space B1 can be ensured.

Figure 9A:
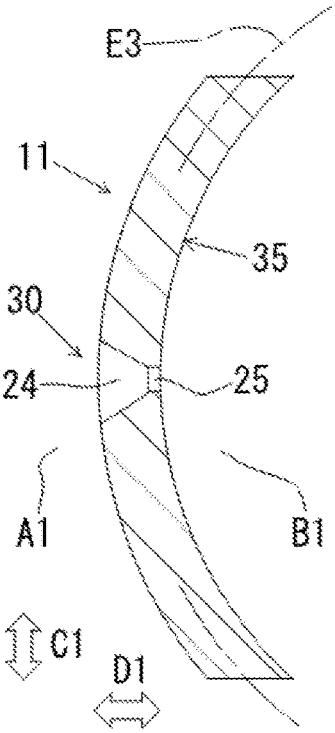
FIG. 9A is a schematic side-section view of the wall.
Figure 9B:
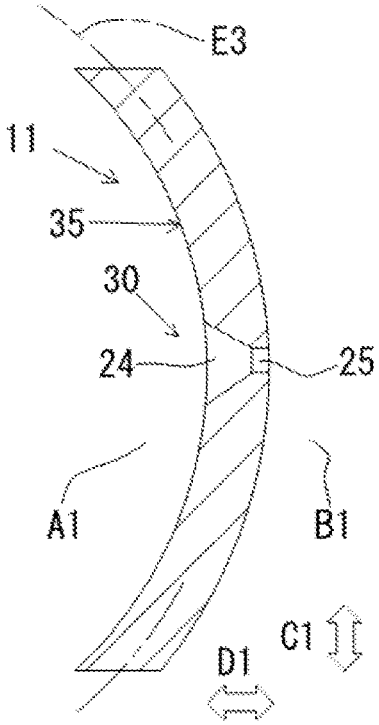
FIG. 9B is a schematic side-section view of the wall.

FIGS. 9A, 9B, 9C, and 9D are schematic cross-sectional views illustrating other shapes of the body section 35 of wall 11. FIGS. 9A and 9B show side sections of wall 11. The virtual line E3 of the body section 35 shown in FIG. 9A is a circular arc or curved line. In other words, the body section 35 is curved so that a substantial center of the vertical direction C1 is closer to the outside A1 than an upper end and a lower end of the vertical direction C1. The virtual line E3 of the body section 35 shown in FIG. 9B is a circular arc or curved line. In other words, the body section 35 is curved so that a substantial center of the vertical direction C1 is closer to the living space B1 than an upper end and a lower end of the vertical direction C1.

Figure 9C:
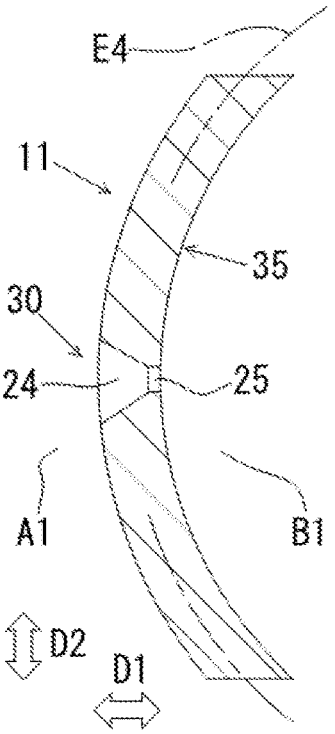
FIG. 9C is a schematic side-plane view of the wall.
Figure 9D:
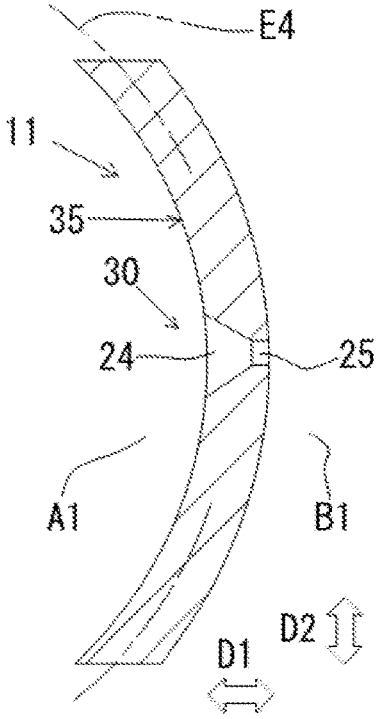
FIG. 9D is a schematic side-plane view of the wall.

FIGS. 9C and 9D show planar cross sections of the wall 11. The virtual line E4 of the body section 35 shown in FIG. 9C is a circular arc or curved line. In other words, the body section 35 is curved so that a substantial center of the second direction D2 is closer to the outside A1 than both ends of the second direction D2. The virtual line E4 of the body section 35 shown in FIG. 9D is a circular arc or curved line. In other words, the body section 35 is curved so that a substantial center of the second direction D2 is closer to the living space B1 than both ends of the second direction D2. In all of FIGS. 9A, 9B, 9C, and 9D, the ventilation device 30 is shown singly for convenience, but multiple ventilation devices may be provided.

The body section 35 shown in FIGS. 9A, 9B, 9C, and 9D, respectively, may have the vertical frames 12 and horizontal frames 13 shown in FIG. 2 through 8 or maybe a solid structure. Furthermore, the ventilation devices 30 shown in FIGS. 9A, 9B, 9C, and 9D, respectively, have at least one of the configurations of the ventilation devices 30 shown in FIG. 2 through 8. Thus, the ventilation devices 30 shown in FIGS. 9A, 9B, 9C, and 9D, respectively, can achieve the same effect as the ventilation devices 30 shown in FIG. 2 through 8. Furthermore, in FIG. 2 through 8, when the ventilation device 30 is unitized, it is possible to provide a hole or space in the body section of the existing wall 11, install the ventilation device 30 in the hole or space, and secure the ventilation device 30 to the body section.

(Supplemental Explanation)

An example of the technical meaning of the matters described in the embodiment is as follows. The building 10 is an example of a building. The wall 11 is an example of a structure. The ventilation device 30 is an example of a ventilation device. The outside A1 is an example of a first space, and the living space B1 is an example of a second space. The body section 35 is an example of a body section. The first ventilation channel 24 and the second ventilation channel 25 are examples of ventilation channels. The first ventilation channels 24, 24A, 24B, 24C, and 24D are examples of the first ventilation channel, respectively, and the second ventilation channels 25, 25A, 25B, 25C, and 25D are examples of the second ventilation channel, respectively. The virtual line E1 is an example of a "virtual line indicating a center of the ventilation channel". The first tube section 14 is an example of a first tube section, and the second tube section 23 is an example of a second tube section. The arrangement range L1 is an example of the arrangement range of the first ventilation channel, and the arrangement range L2 is an example of the arrangement range of the second ventilation channel Adjacent vertical frames 12 and adjacent horizontal frames 13 forms an annular frame.

The ventilation device described in this embodiment is not limited to those described in the drawings. For example, the thickness of the wall body in the first direction may be constant in the vertical direction or may vary in the vertical direction. The thickness of the wall body in the first direction may be constant in the horizontal direction or may vary in the horizontal direction. In addition, the frames that consist of the wall body can be provided in a grid shape in the front view of the wall, in a curved shape in the front view of the wall, or in an annular shape in the front view of the wall. The number of curved-shaped frames may be any number, single or multiple. The number of annular frames may be any number, single or multiple. Annular frames include triangular frames, circular frames, quadrangular frames, hexagonal frames, and the like. When an annular frame is provided, a ventilation device can be installed in the area of the wall body enclosed by the annular frame. Furthermore, the building can be any of single-family residence, warehouse, gymnasium, multi-used building, high-rise building, apartment complex, and the like. Furthermore, the body section may be made of metal, wood, synthetic resin, mortar, or any combination of several of these.

In this embodiment, wall 11 as a structure, as shown in FIG. 1, may be provided to separate the living space B1 provided inside the building 10 and the living space B2 provided inside the building 10. The wall 11 is also provided inside the building 10. In this case, the living space B1 is the first space, and the living space B2 is the second space. Then, the air in the living space B1 is sent to the living space B2 through the ventilation device 30 provided in the wall 11. Furthermore, a ventilation device 30 may be provided in a wall 11 separating the living space B2 from the outside A1. In this case, the living space B2 is the first space and the outside A1 is the second space. Then, the air in the living space B2 is sent to the outside A1 through the ventilation device 30 provided in the wall 11. Thus, the ventilation performance of the living space B2 is improved. In addition, either the first space or second space may be a toilet, oshiire (Japanese built-in closet), closet, and the like. In addition, the first space may be inside the building and the second space may be outside the building. In this case, the air inside the building is sent to the outside of the building by the ventilation device of the structure. Thus, ventilation performance inside the building is improved.

INDUSTRIAL APPLICABILITY

The structure of this disclosure can be installed and used as a wall for sending the air from a first space to a second space.

DESCRIPTION OF THE REFERENCE NUMERALS

10 . . . Building, 11 . . . Wall, 12 . . . Vertical frame, 13 . . . Horizontal frame, 14 . . . First tube section, 23 . . . Second tube section, 24, 24A, 24B, 24C, 24D . . . First ventilation channel, 25, 25A, 25B, 25C, 25D . . . Second ventilation channel, 30 . . . Ventilation device, 35 . . . Body section, A1 . . . Outside, B1, B2 . . . Living space, E1 . . . Virtual line, L1, L2 . . . Arrangement range

The invention claimed is:

1. A structure, comprising:

a body section separating a first space from a second space;

a ventilation device provided in the body section and sending air in the first space to the second space, wherein an arrangement range of the ventilation device in a thickness direction of the body section is within an arrangement range of the body section, wherein:

the ventilation device includes:

a first tube section provided with a plate separating the first space from the second space, and a second tube section connected to the first tube section, wherein:

the first tube section has a first ventilation channel formed by the plate surrounding the first ventilation channel; and the second tube section has a second ventilation channel connecting to the first ventilation channel, the second ventilation channel located between the first ventilation channel and the second space, wherein a virtual line indicates a center of the second ventilation channel, a cross-sectional area of the second ventilation channel in a plane perpendicular to the virtual line is identical at any position along the virtual line, a cross-sectional area of the first ventilation channel in a plane perpendicular to the virtual line narrows as it approaches the inside along the virtual line, and wherein:

in a direction along the virtual line, the arrangement range of the first ventilation channel exceeds the arrangement range of the second ventilation channel.

2. The structure according to claim 1, wherein:

the first space is outside of a building, and the second space is inside of the building.

3. The structure according to claims 1, wherein:

the body section has an annular frame in a plane perpendicular to the virtual line, and the first ventilation channel and the second ventilation channel are provided inside the frame.

4. The structure according to claim 1, wherein:

the first space is a first living space provided inside a building, and the second space is a second living space provided inside the building.

5. The structure according to claim 1, wherein:

the first space is inside a building, and the second space is outside the building.

6. The structure according to claim 1, further comprising:

a sealing device sealing the second ventilation channel, wherein the sealing device is able to be attached to and detached from the second tube section.

* * * * *